US011178498B2

(12) United States Patent
Fichtl

(10) Patent No.: US 11,178,498 B2
(45) Date of Patent: Nov. 16, 2021

(54) HEARING DEVICE SYSTEM AND A METHOD FOR DYNAMICALLY PRESENTING A HEARING DEVICE MODIFICATION PROPOSAL TO A USER OF A HEARING DEVICE

(71) Applicant: Sonova AG, Stafa (CH)

(72) Inventor: Elmar Fichtl, Hombrechtikon (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/756,152

(22) PCT Filed: Oct. 16, 2017

(86) PCT No.: PCT/EP2017/076349
§ 371 (c)(1),
(2) Date: Apr. 15, 2020

(87) PCT Pub. No.: WO2019/076432
PCT Pub. Date: Apr. 25, 2019

(65) Prior Publication Data
US 2020/0245084 A1 Jul. 30, 2020

(51) Int. Cl.
*H04R 25/00* (2006.01)

(52) U.S. Cl.
CPC ..... *H04R 25/70* (2013.01); *H04R 25/305* (2013.01); *H04R 25/558* (2013.01); *H04R 2225/41* (2013.01)

(58) Field of Classification Search
CPC ..... H04R 25/00
USPC ..... 381/312, 316, 320
See application file for complete search history.

(56) References Cited

U.S. PATENT DOCUMENTS

2005/0129262 A1* 6/2005 Dillon ..... A61N 1/36038 381/312
2010/0202636 A1 8/2010 Frohlich et al.
2015/0023535 A1 1/2015 Shennib
2015/0281853 A1* 10/2015 Eisner ..... H04R 25/505 381/312

FOREIGN PATENT DOCUMENTS

WO 2017/118477 A1 7/2017
WO 2018/006979 A1 1/2018

OTHER PUBLICATIONS

International Search Report for PCT/EP2017/076349 dated Jul. 12, 2018.
Written Opinion for PCT/EP2017/076349 dated Jul. 12, 2018.

* cited by examiner

*Primary Examiner* — Suhan Ni
(74) *Attorney, Agent, or Firm* — Pearne & Gordon LLP

(57) ABSTRACT

A hearing device system including a hearing device, a user interface communicatively coupled to the hearing device, and a module for processing a psychoacoustic model. The psychoacoustic model is adapted to derive a modification proposal based on hearing relevant data, wherein the modification proposal is adapted to solve a hearing issue of the user of the hearing device. The hearing device system is adapted to dynamically present the modification proposal to the user via the user interface, and to adapt the user interface such to receive inputs made by the user to the dynamically presented modification proposal.

18 Claims, 3 Drawing Sheets

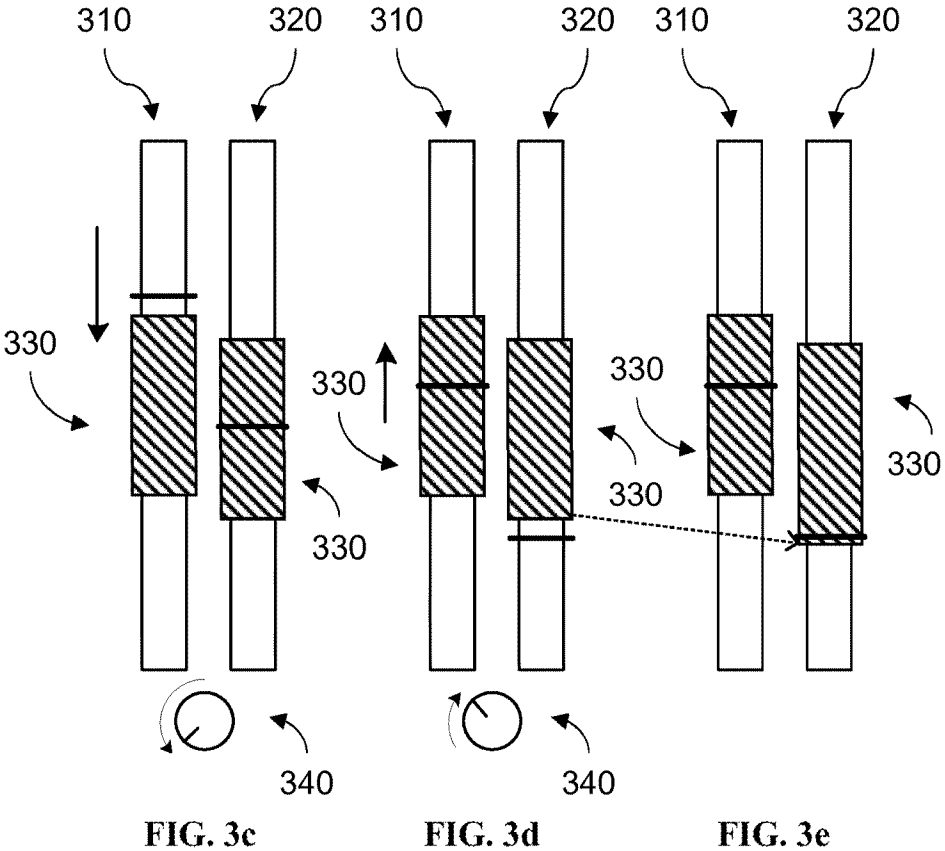
FIG. 3c
FIG. 3d
FIG. 3e
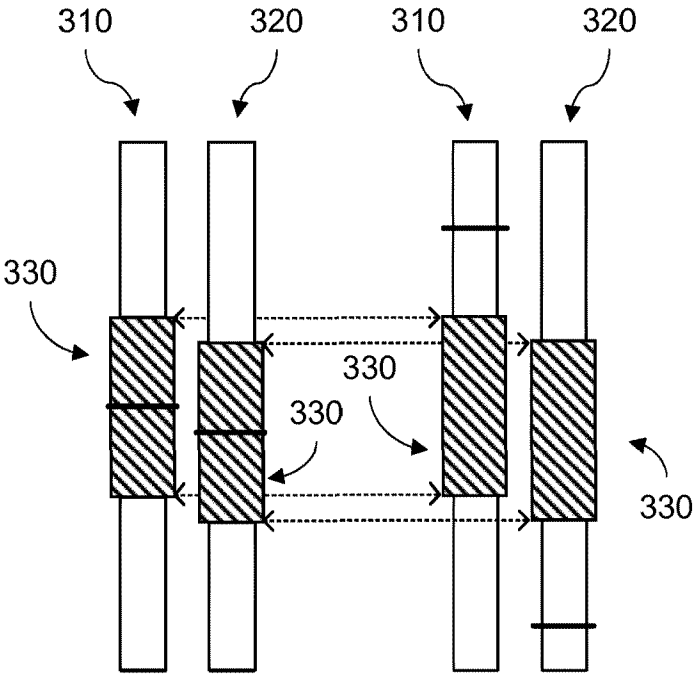
FIG. 3a
FIG. 3b

HEARING DEVICE SYSTEM AND A METHOD FOR DYNAMICALLY PRESENTING A HEARING DEVICE MODIFICATION PROPOSAL TO A USER OF A HEARING DEVICE

TECHNICAL FIELD

The present invention is related to a hearing device system and a method for dynamically presenting a hearing device modification proposal to a user of a hearing device via a user interface.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

In the field of hearing devices, it is known in the prior art to solve a hearing issue as soon as the user perceives this hearing issue and wants it to remove. However, there may be various kinds of hearing issues the user wants to remove.

Today's fitting and fine tuning of a hearing device can be performed in an office of a hearing care professional (HCP). In an example, the hearing care professional can be provided with descriptions of hearing issues the user remembers and tries to describe. Based on this information, the hearing care professional tries to find out a solution, which might be able to solve these hearing issues. However, one disadvantage of this commonly known fitting can rely in that it happens at a time, location and/or situation, which can be inappropriately for the patient. One further disadvantage of this commonly known fitting can rely in that it happens in an artificial situation, which may hardly match the needs of the hearing device user in daily life. One further disadvantage of the commonly known fitting can be that it happens in a time, location and/or situation in which the hearing issue does not occur and thus fitting could only be performed based on retrospection of the patient.

In an alternative approach, fitting of the hearing device can be performed in real life condition by the user himself. In an example, the user can be provided with only one single modifier or rather control. However, it has been shown that the effect of this single control can be limited, i.e. only a small set of hearing issues can be solved properly. In another example, the user can be provided with more controls, e.g. five or even more. However, providing the user with an increased number of controls can be very challenging for the user, since he will hardly be able to know and remember the effect of every modifier involved in this control and may end up in a trial and error procedure.

It is therefore an object of the present invention to provide a hearing device system solving the problems known in the prior art. It is further object of the present invention to provide a method for dynamically presenting a hearing device modification proposal to a user of a hearing device of said hearing device system via a user interface.

SUMMARY OF THE INVENTION

The present invention is directed to a hearing device system comprising a hearing device, a user interface communicatively coupled to the hearing device, and a module for processing a psychoacoustic model. Said psychoacoustic model is adapted to derive a modification proposal based on hearing relevant data, wherein said modification proposal is adapted to solve a hearing issue of the user of said hearing device. Said hearing device system is adapted to dynamically present the modification proposal to the user via the user interface, and to adapt the user interface such to receive inputs made by the user to said dynamically presented modification proposal.

Hence, provided is a hearing device system which omits presenting to much modifiers for the actual hearing issue to the user. Rather, the inventive hearing device system provides most appropriate modification(s) for the actual hearing issue. This approach however requires deriving information about which modification may be most beneficial for the actual hearing issue. According to the invention, a modification proposal is derived by means of the psychoacoustic model based on hearing relevant data, wherein said modification proposal is adapted to solve the hearing issue of the user of said hearing device. Once derived, the modification proposal is dynamically presented to the user via the user interface of the hearing device system. It is to be noted that the "modification proposal" presented to the user via the user interface can encompass e.g. one or more modifier(s), e.g. adjustment icon(s) displayed on the user interface. The one or more modifier(s) can include e.g. one or more of a slider, a button, a control dial, etc.

In an embodiment of the proposed hearing device system the hearing relevant data is supplied to the psychoacoustic model by means of data acquisition means, said hearing relevant data comprise at least one of property data, a hearing device user state, classifier analysis data, and sound processing unit data. Based on the supplied hearing relevant data, the psychoacoustic model is allowed to dynamically predict the most relevant modification proposal which is to be presented to the user.

In an embodiment of the proposed hearing device system the property data represents hearing device and/or hearing device user properties representing at least one of hearing loss of the user, type of acoustic coupling and hearing device properties. The property data can comprise, but is not limited to, information about hearing loss of the user, hearing aid properties, and a type of acoustic coupling, which type can more or less directly or indirectly depend on a type of the hearing device used, e.g. a Behind-the-Ear hearing device, an In-the-Ear hearing device, etc.

In an embodiment of the proposed hearing device system the hearing device user state represents at least one current user state used to generate predicting perceptive dimensions representing at least one of loudness, sharpness, intelligibility, familiarity and hearing effort. In an example, the hearing device provides the current state of signal processing to the psychoacoustic model for predicting perceptive dimensions, including at least one of loudness, sharpness, intelligibility, familiarity, hearing effort.

In an embodiment the proposed hearing device system further comprises a classifier adapted to generate the classifier analysis data based on an analysis of received sound, and to transmit resulting classifier analysis data to at least the psychoacoustic model.

In an embodiment the proposed hearing device system further comprises a sound processing unit (SPU) supplied with the classifier analysis data from the classifier, said sound processing unit (SPU) is adapted to perform sound processing on the received data and to transmit resulting sound processing data to the module for processing a psychoacoustic model.

In an embodiment of the proposed hearing device system the analysis is based on at least one of global signal level, spectral signal levels, signal-to-noise ratio (SNR) and dynamic properties of sound.

In an embodiment the proposed hearing device system is adapted to frequently supply results of the analysis to the module for processing a psychoacoustic model. In an example, the hearing device frequently provides results of the analysis (e.g. global signal level, spectral signal levels, SNR, dynamic properties of sound) to the psychoacoustic model of the Dynamic Modifier.

In a further embodiment the proposed hearing device system is adapted to provide results of the analysis to the module for processing a psychoacoustic model upon a prompt made by the user via the interface. In an example, the user can initiate the hearing device to provide results of the analysis (e.g. global signal level, spectral signal levels, SNR, dynamic properties of sound) to the psychoacoustic model of the dynamic modifier. The dynamic modifier may request the user for further information, e.g. about the actual hearing activity or hearing demand.

In an embodiment of the proposed hearing device system the module for processing a psychoacoustic model, based on the received data, is adapted to evaluate performance and/or benefit of the hearing device to be expected by the hearing device user.

In an embodiment of the proposed hearing device system the module for processing a psychoacoustic model is adapted to compare the actual performance with at least one reference model. Hence, the module for processing a psychoacoustic model can evaluate, based on received data, the expected performance and the benefit of the hearing device for the user. Further, the module for processing the psychoacoustic model can compare the actual performance with a reference model. In an example, the hearing ability of a normal hearing person can serve as the reference model.

In an embodiment of the proposed hearing device system the reference model comprises a predefined range of a normal performance hearing perception level defined as hearing ability of a person having normal hearing ability or a predefined range of a lower performance hearing perception level defined as at least sufficient for hearing.

In an embodiment of the proposed hearing device system the module for processing a psychoacoustic model is adapted to derive modification proposals, said modification proposals are provided to the user once requested by the user for better hearing support. For example, if the psychoacoustic model detects that the range of acceptable understandability and transparency is reduced or even lost, the psychoacoustic model derives modification proposals, which can be provided once the customer requests for better hearing support. Proposed modifications can be the same as modifications provided in fine tuning techniques provided by the fitting software. In an example, in case of the psychoacoustic model is not able to derive an appropriate modification, the module for processing a psychoacoustic model can inform the user or, if necessary, can recommend other actions, e.g. looking for a quiet room, visiting a hearing care professional (HCP), etc.

In an embodiment of the proposed hearing device system the module for processing a psychoacoustic model is adapted to prioritize modification proposals based on predetermined hearing situations. Assuming the requested modification depends on the hearing activity or hearing demand of the user, the psychoacoustic model can need to provide more than one modification proposal. The hearing demands or hearing activities can be more or less strongly linked to certain hearing situations. In an example, modification proposals may be prioritized based on e.g. a probability that a hearing task may occur in a certain hearing situation. Assuming a sound situation which contains speech and music, the user can want to understand speech, but can in contrast rather want to hear the music. Therefore, in this case, the psychoacoustic model can provide a first modification for the perceptual dimension "speech intelligibility" (e.g. more beamformer, more noise canceller, etc.) and a second modification for the perceptual dimension "musical enjoyment" (e.g. more linear gain model, less sound cleaning, etc.).

In an embodiment of the proposed hearing device system the module for processing a psychoacoustic model is implemented in the hearing device itself or in at least one external appliance communicatively coupled to the hearing device, comprising an external device, in particular a smart-phone, a smart-watch, a wearable, a central webserver or a cloud-server.

In an embodiment of the proposed hearing device system the interface is comprised by an external appliance communicatively coupled to the hearing device, in particular at least one of a smart-phone, a smart-watch and a wearable. The coupling between the hearing device and the external appliance can be achieved by means of a standardized wireless connection, e.g. Bluetooth, etc., or non-standard wireless connection.

Moreover, the present invention is directed to a method for dynamically presenting a hearing device modification proposal to a user of a hearing device via a user interface. Said method comprises the steps of supplying hearing relevant data to a module for processing a psychoacoustic model by means of data acquisition means; in the psychoacoustic model, deriving the modification proposal based on the hearing relevant data; and dynamically presenting the derived modification proposal to the user via the user interface.

In an embodiment the proposed method further comprises the step of modifying the hearing device based on inputs made by the user to said dynamically presented modification proposal via the interface.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is:

FIGS. 3*a*-3*e* schematically depict dynamic modification of the hearing device system.

DETAILED DESCRIPTION OF THE INVENTION

Figure 1:
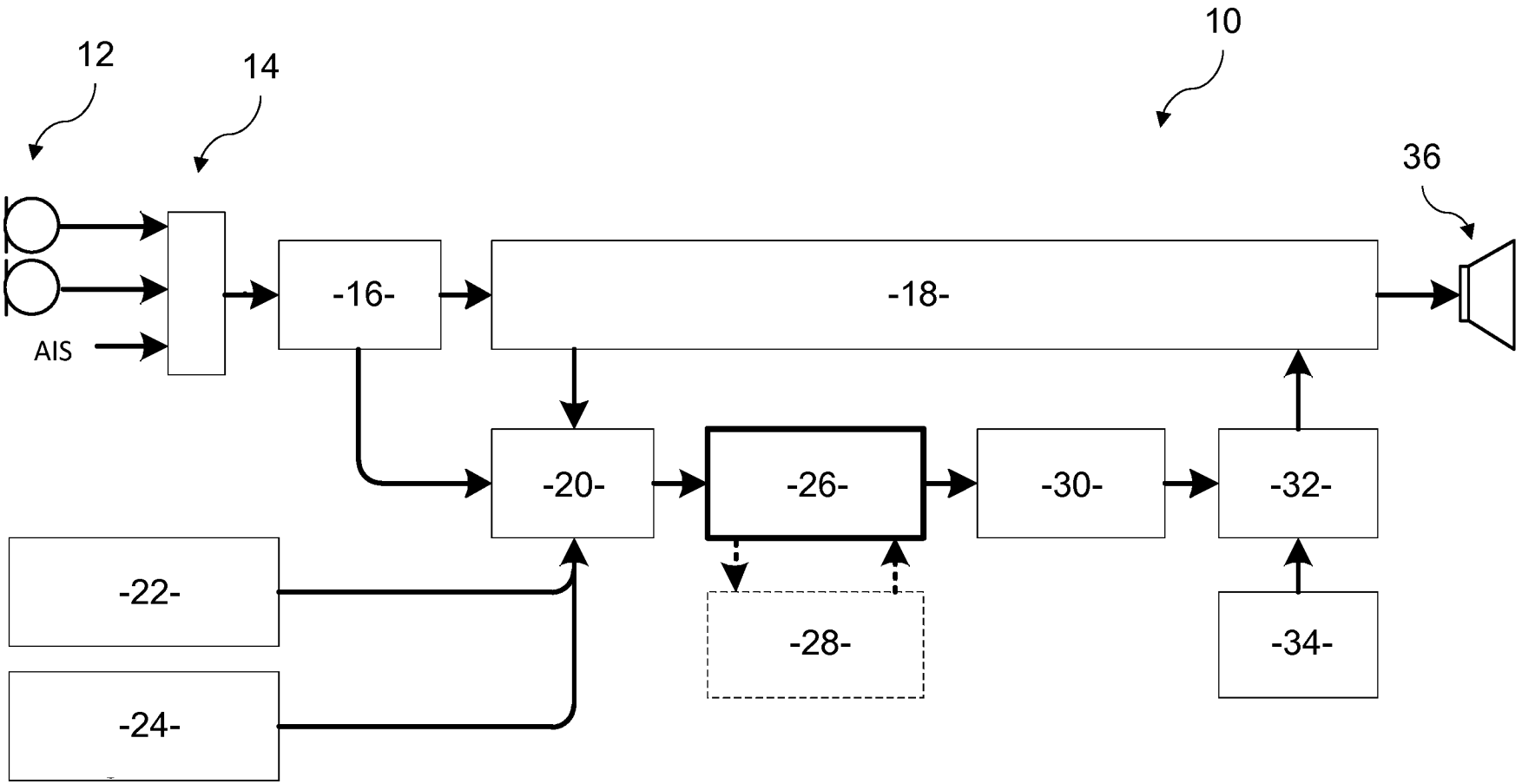
FIG. 1 schematically depicts a hearing device system according to the invention.

FIG. 1 shows a diagram of a hearing device system 10 according to an embodiment of the present invention. The hearing device system 10 can comprise circuity of a hearing device as well as e.g. an external appliance, to be explained in more detail in the following.

A microphone system 12 is used to receive sound from the environment. In the shown example, the microphone system 12 comprises two microphones. While not shown, more or less than two microphones can be used. The microphone system 12 converts the received sound into electrical signals which are transferred to an input unit 14. As an option, sound received from an alternative input source (AIS), e.g. a remote microphone, etc. (nor shown), can be supplied to the input unit 14, as well. In the input unit 14, the collected sound can be subjected to a pre-processing. The result of the input unit 14 can be supplied to a sound analysis unit 16, also sometimes referred as "classifier". The sound analysis unit 16 can be adapted to generate classifier analysis data based on an analysis of the received sound. The analysis can be based on at least one of global signal level, spectral signal levels, signal-to-noise ratio (SNR) and dynamic properties of sound.

The resulting classifier analysis data can be transmitted from the sound analysis unit 16 to a sound processing unit (SPU) 18, which is adapted to perform sound processing on the received data. Resulting sound processing data can be transmitted from the sound processing unit 18 to a data acquisition means 20. Alternatively, or as an option, the resulting classifier analysis data can be transmitted from the sound analysis unit 16 to the data acquisition means 20, directly, i.e. without intervention by the sound processing unit 18.

The data acquisition means 20 can further acquire data from a property data module 22 and/or a user state module 24, to be described in the following. The property data module 22 is adapted to generate property data representing hearing device and/or hearing device user properties representing at least one of hearing loss of the user, type of acoustic coupling and hearing device properties. The user state module 24 is adapted to generate a hearing device user state representing at least one current user state used to generate predicting perceptive dimensions representing at least one of loudness, sharpness, intelligibility, familiarity and hearing effort.

Referring back to the data acquisition means 20, the acquired data, sometimes referred as hearing relevant data, is supplied to a module 26 for processing a psychoacoustic model. In other words, the module 26 is supplied with hearing relevant data which comprises at least one of property data received form the property data module 22, a hearing device user state received from the user state module 24, classifier analysis data received from the sound analysis unit 16, and sound processing unit data received from the sound processing unit 18. In the module 26, the psychoacoustic model is adapted to derive a modification proposal based on the received hearing relevant data, wherein said modification proposal is adapted to solve a hearing issue of the user of the hearing device. To put it in other words, the psychoacoustic model 26 is fed with hearing relevant data and is used to monitor and evaluate the actual sound. As soon as a real or potential hearing issue occurs, the psychoacoustic model 26 is used to derive a modification proposal, which is capable of solving this hearing issue. The hearing device system 10 is adapted to dynamically present the derived modification proposal to the user, to be described in more detail in the following. The user interface itself is capable to receive inputs made by the user to said dynamically presented modification proposal, to be described in more detail in the following, too.

Results of the proposed modification as derived by the psychoacoustic model 26 can be subjected to a trade-off management performed in a trade-off management unit 28. The trade-off management unit 28 can check if a proposed modification also has positive or negative impact on other sound types than the current sound situation. This may be recommended, if the requested modification shall be applied permanently and not only temporarily. Results of the psychoacoustic model 26 can be transferred to a modification proposals module 30 for providing the modification proposal to an associated user interface 32, which is part of the hearing device system 10. This user interface 32 can be comprised in an external device, e.g. a smart-phone, a smart-watch, a wearable, etc., communicatively connected to the hearing device. The modification proposal is dynamically presented to the user via the user interface 32, which is also capable to receive user interaction 34 made by the user to said dynamically presented modification proposal. In an example, the user interface 32 can comprise a touch-screen which can be able to dynamically present the modification proposal to the user as well as to receive user interaction 34 made by the user to said presented modification proposal. The user interface 32 supplies the user interaction 34 to the sound processing unit 18, which in turn adjusts sound, which is output to the user, based on the received modification performed by the user. The thus adjusted sound is output to a receiver 36 of the hearing device.

Figure 2A:
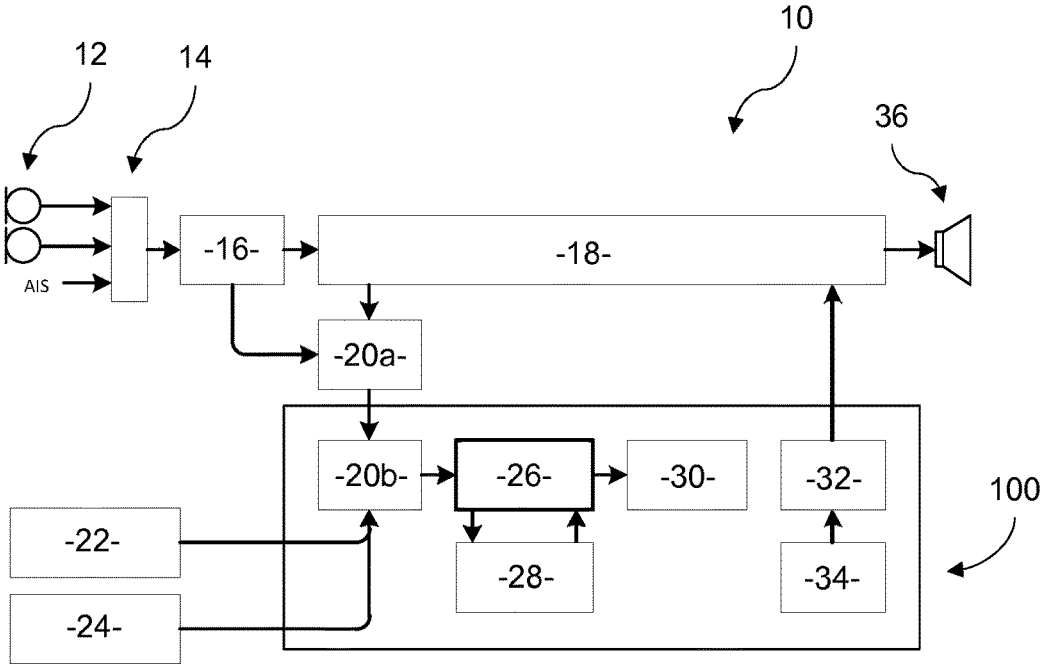
FIGS. 2*a*-2*b* schematically depict a hearing device system in different embodiments.

FIGS. 2*a,b* show the hearing device system 10 in exemplary embodiments. As mentioned above, the hearing device system 10 comprises the hearing device itself as well as an external device 100, as schematically illustrated in FIG. 2*a*. This external device 100 can be embodied as a device capable of dynamically presenting the modification proposal to the user, as well as to receive inputs made by the user to said presented modification proposal. The external device 100 can be further adapted to perform operation of at least the psychoacoustic model 26, trade-off management unit 28 and modification proposals module 30, as well as the above-mentioned capability of presenting the modification proposal to the user and the capability of receiving inputs made by the user. In other words, at least one of the psychoacoustic model 26, trade-off management unit 28 and modification proposals module 30 can be implemented in the external device 100. In an example, the external device 100 can be comprised by or rather implemented in a smart-phone, a smart-watch, a wearable, etc. The data acquisition means 20 as depicted in FIG. 1 can be split into a first data acquisition means 20*a* (which can be comprised in the hearing device) and a second data acquisition means 20*b* (which can be comprised in the external device 100).

Figure 2B:
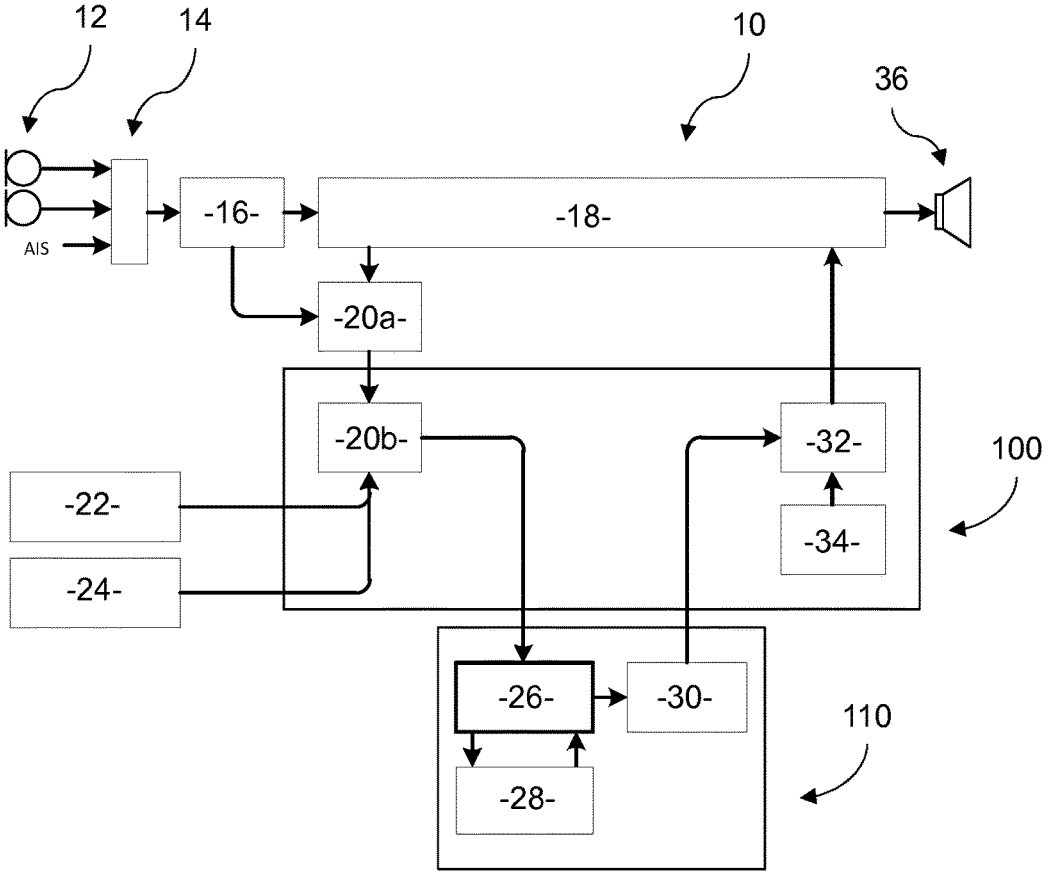

In the embodiment as depicted in FIG. 2*b*, the operation of at least the psychoacoustic model 26, trade-off management unit 28 and modification proposals module 30 can be executed in an external server 110, e.g. a web-server or the cloud, communicatively connected to the hearing device system 10. In other words, at least one of the psychoacoustic model 26, trade-off management unit 28 and modification proposals module 30 can be implemented in the external server 110. While not shown, at least the psychoacoustic model 26 can be implemented in the hearing device itself. The first data acquisition means 20*a* can be comprised in the hearing device, while the second data acquisition means 20*b* can be comprised in the external device 100.

FIGS. 3*a-e* depict advantages of the invention in a schematically modification scenario or rather "slider control" view. As mentioned above, the dynamic modifier can perform a trade-off management for the proposed modification, i.e. it checks whether a proposed modification also has positive or negative impact on other sound types than the current sound situation. The module for processing a psychoacoustic model is adapted to compare the actual performance with at least one reference model. The figures illustrate a modification scenario that can be performed in a hearing device system according to the present invention, as e.g. shown in FIGS. 1, 2*a,b*. Assumed is a scenario of adjusting a "loudness perception" level 310 as well as adjusting a "sharpness perception" level 320. The "loudness perception" level 310 can be adjusted in a range between "too soft" and "too loud", while the "sharpness perception" level 320 can be adjusted in a range between "too dull" and "too sharp".

In FIG. 3*a*, a reference adjustment of a normal hearing people is shown, also referred as reference model. Respective sliders, schematically depicted in the figures as horizontally aligned bars, are shown to be set into a range (e.g. into the middle thereof) which can be perceived by the normal hearing people as "good". This range can be referred as acceptable range 330, schematically illustrated as hatched boxes in the figures. Any settings lying in the remaining portions of the columns can be perceived by the normal hearing people as "bad", i.e. too loud, too soft, too dull, too sharp, etc. The reference model can comprise a predefined range of a normal performance hearing perception level defined as hearing ability of a person having normal hearing ability or a predefined range of a lower performance hearing perception level defined as at least sufficient for hearing.

The respective reference settings and settings made by the user in the actual hearing device are compared to each other (refer to FIGS. 3*a,b*). In an example, as shown in FIG. 3*b*, in this actual setting, the loudness- and sharpness perception sliders are outside of or rather distant from the acceptable ranges 330, respectively. As a result, the predicted perception can be "too loud" and "too boomy". Therefore, the proposed modification can include: "decrease gain & increase high frequency".

In a first adjustment (refer to FIG. 3*c*), while increasing the frequency, the user can adjust the sharpness perception to the middle of the acceptable range. Further, the user is allowed to, by means of exemplary illustrated control dials 340, decrease the gain (loudness), as exemplary illustrated by an arrow pointing downwards (refer to FIG. 3*c*). It is assumed that this adjustment is not accepted by the user.

In a second (subsequent) adjustment (refer to FIG. 3*d*), the gain is decreased such to enter the acceptable range, while the user is allowed to increase the sharpness perception level, as exemplary illustrated by an arrow pointing upwards. The setting resulting from this adjustment is illustrated in FIG. 3*e*. It is assumed that this adjustment is accepted by the user. It is to be noted, that in the latter adjustment the slider would be distant from or rather out of the acceptable range 330. However, based on this scenario and as shown in FIG. 3*e*, the customizing psychoacoustic model modifies this acceptable range 330 such to at least overlap with the slider level. This is achieved by means of extending or rather increasing the lower threshold of the acceptable range 330 (schematically illustrated by extending the lower threshold of the acceptable range 330 downwards). In this exemplary scenario, the dynamic modifier provides logged information also to the psychoacoustic model in order to adjust the algorithm and the thresholds for predicting the modification proposal. Advantageously, these data may be used for customizing the psychoacoustic model to the individual needs of the customer in the course of time.

What is claimed is:

1. A hearing device system (10) comprising a hearing device, a user interface (32) communicatively coupled to the hearing device, and a module for processing a psychoacoustic model (26), said psychoacoustic model (26) is adapted to derive a modification proposal based on hearing relevant data, wherein said modification proposal is adapted to solve a hearing issue of the user of said hearing device, wherein said hearing device system (10) is adapted to dynamically present the modification proposal to the user via the user interface (32), and to adapt the user interface (32) such to receive inputs made by the user to said dynamically presented modification proposal, wherein the module for processing a psychoacoustic model (26), based on the received data, is adapted to evaluate performance and/or benefit of the hearing device to be expected by the hearing device user.

2. The hearing device system (10) according to claim 1, wherein the hearing relevant data is supplied to the psychoacoustic model (26) by means of data acquisition means (20;20*a*,20*b*), said hearing relevant data comprise at least one of property data, a hearing device user state, classifier analysis data, and sound processing unit data.

3. The hearing device system (10) according to claim 2, wherein the property data represent hearing device and/or hearing device user properties representing at least one of hearing loss of the user, type of acoustic coupling and hearing device properties.

4. The hearing device system (10) according to claim 2, wherein the hearing device user state represents at least one current user state used to generate predicting perceptive dimensions representing at least one of loudness, sharpness, intelligibility, familiarity and hearing effort.

5. The hearing device system (10) according to claim 2, further comprising a classifier (16) adapted to generate the classifier analysis data based on an analysis of received sound, and to transmit resulting classifier analysis data to at least the psychoacoustic model (26).

6. The hearing device system (10) according to claim 5, further comprising a sound processing unit (18) supplied with the classifier analysis data from the classifier (16), said sound processing unit (18) is adapted to perform sound processing on the received data and to transmit resulting sound processing data to the module for processing a psychoacoustic model (26).

7. The hearing device system (10) according to claim 5, wherein the analysis is based on at least one of global signal level, spectral signal levels, signal-to-noise ratio (SNR) and dynamic properties of sound.

8. The hearing device system (10) according to claim 5, adapted to frequently supply results of the analysis to the module for processing a psychoacoustic model (26).

9. The hearing device system (10) according to claim 5, adapted to provide results of the analysis to the module for processing a psychoacoustic model (26) upon a prompt made by the user via the interface (32).

10. The hearing device system (10) according to claim 1, wherein the module for processing a psychoacoustic model (26) is adapted to compare the actual performance with at least one reference model.

11. The hearing device system (10) according to claim 10, wherein the reference model comprises a predefined range of a normal performance hearing perception level defined as hearing ability of a person having normal hearing ability or a predefined range of a lower performance hearing perception level defined as at least sufficient for hearing.

12. The hearing device system (10) according to claim 11, wherein the module for processing a psychoacoustic model (26) is adapted to derive modification proposals, said modification proposals are provided to the user once requested by the user for better hearing support.

13. The hearing device system (10) according to claim 1, wherein the module for processing a psychoacoustic model (26) is adapted to prioritize modification proposals based on predetermined hearing situations.

14. The hearing device system (10) according to claim 1, wherein the module for processing a psychoacoustic model (26) is implemented in the hearing device itself or in at least one external appliance (110) communicatively coupled to the hearing device, comprising an external device, in particular a smart-phone, a smart-watch, a wearable, a central webserver or a cloud-server.

15. The hearing device system (10) according to claim 1, wherein the interface (32) is comprised by an external appliance (110) communicatively coupled to the hearing device, in particular at least one of a smart-phone, a smart-watch and a wearable.

16. A method for dynamically presenting a hearing device modification proposal to a user of a hearing device via a user interface (32), said method comprising:

supplying hearing relevant data to a module for processing a psychoacoustic model (26) by means of data acquisition means (20;20*a*,20*b*), in the psychoacoustic model, deriving the modification proposal based on the hearing relevant data, dynamically presenting the derived modification proposal to the user via the user interface (32), and evaluating, based on the received data, performance and/or benefit of the hearing device to be expected by the hearing device user.

17. The method according to claim 16, further comprising the step of modifying the hearing device based on inputs made by the user to said dynamically presented modification proposal via the interface (32).

18. A hearing device system (10) comprising a hearing device, a user interface (32) communicatively coupled to the hearing device, and a module for processing a psychoacoustic model (26), said psychoacoustic model (26) is adapted to derive a modification proposal based on hearing relevant data, wherein said modification proposal is adapted to solve a hearing issue of the user of said hearing device, wherein said hearing device system (10) is adapted to dynamically present the modification proposal to the user via the user interface (32), and to adapt the user interface (32) such to receive inputs made by the user to said dynamically presented modification proposal, wherein the module for processing a psychoacoustic model (26) is adapted to prioritize modification proposals based on predetermined hearing situations.

* * * * *